US006000721A

United States Patent [19]

Pfaeffle

[11] Patent Number: 6,000,721

[45] Date of Patent: Dec. 14, 1999

[54] IN-LINE SKATES WITH FIBER OPTIC LIGHTING

[76] Inventor: Patricia Pfaeffle, 72 S. Charles St., Hopelawn, N.J. 08861

[21] Appl. No.: 08/772,810

[22] Filed: Dec. 24, 1996

[51] Int. Cl.[6] ..... B62M 1/00

[52] U.S. Cl. ..... 280/890; 280/11.19; 280/87.042

[58] Field of Search ..... 280/11.19, 11.2, 280/11.22, 87.041, 87.042, 809, 811, 816; 362/61, 78, 103; 36/137

[56] References Cited

U.S. PATENT DOCUMENTS

| | | | |
|---|---|---|---|
| 4,130,951 | 12/1978 | Powell | 36/137 |
| 4,430,692 | 2/1984 | Papadakis | 362/78 |
| 4,997,196 | 3/1991 | Wood | 280/87.042 |
| 5,119,277 | 6/1992 | Copley et al. | 280/87.042 |
| 5,132,883 | 7/1992 | La Lumandier | 280/87.042 |
| 5,149,489 | 9/1992 | Crews | 280/811 |
| 5,217,290 | 6/1993 | Windross | 362/61 |
| 5,327,329 | 7/1994 | Stiles | 280/809 |
| 5,394,312 | 2/1995 | Bland | 36/137 |
| 5,419,570 | 5/1995 | Bollotté | 280/87.041 |
| 5,484,164 | 1/1996 | McInerney et al. | 280/811 |
| 5,588,734 | 12/1996 | Talamo et al. | 280/816 |
| 5,722,757 | 3/1998 | Chien | 36/137 |

*Primary Examiner*—J. J. Swann
*Assistant Examiner*—Frank Vanaman
*Attorney, Agent, or Firm*—Ezra Sutton

[57] ABSTRACT

An in-line roller skate with fiber optic lighting for illuminating a skater's pathway including a boot housing having a plurality of closure means, a top wall, a front wall, a rear wall, side walls and a bottom wall; and a roller wheel assembly connected to the bottom wall of the boot housing including a mounting bracket for supporting a plurality of skate wheels thereon. The in-line roller skate further includes a power source mounted on the boot housing; and a fiber optic lighting assembly for providing light and being connected to the power source and including a light source, a lens and a plurality of fiber optic lines for transmitting light to a plurality of locations on the boot housing and on the mounting bracket.

3 Claims, 7 Drawing Sheets

IN-LINE SKATES WITH FIBER OPTIC LIGHTING

FIELD OF THE INVENTION

This invention relates to skates employing fiber optic lighting, and more particularly, to a fiber optic lighting assembly that provides safety and aesthetic lighting qualities to the in-line skates while in use.

BACKGROUND OF THE INVENTION

Roller skates, in-line skates and the like are an ever increasing sporting activity popularized by children, teens and adults of both sexes. This sporting activity takes place in day light, evening and night time hours where present skates have only reflective strips for illumination to other skaters or pedestrians or traffic when in use during evening or nighttime hours. Skaters presently use reflective clothes and a flashlight for illuminating their path when skating at dusk, evening, twilight or nighttime hours.

Reflective strips on skates and reflective clothes on skaters are dependent on overhead lighting from street lights, or traffic headlights from moving motor vehicles or from flashlights from other skaters. When the aforementioned lights are not present, reflective strips on skates and reflective clothes on skaters are not effective for giving illumination to a pathway, street, or parking area for a skater participating in the skating activity. Skaters do not always have a flashlight while skating, motorists do not necessarily turn-on the headlights of their vehicles until nighttime hours, and street lights may be on a timer that only turns on at a specific time, well past darkness or nighttime.

There remains a need for in-line skates with fiber optic lighting that provides safety and aesthetic lighting to the skates which gives the skater proper pathway illumination, brake light illumination and skate illumination for the skater, other skaters, pedestrians, and motorists when in use.

DESCRIPTION OF THE PRIOR ART

Roller skates and in-line skates having a lighting system have been disclosed in the prior art. U.S. Pat. No. 5,484,164 to McInerney et al discloses a roller skate lighting system having lights (light bulbs) that snap into the boot and are connected to a power source via an electrical circuit. This prior art patent does not disclose the particular structure and design of the in-line roller skate of the present invention.

None of the prior art patents for in-line skates or roller skates disclose the use of a fiber optic lighting arrangement.

Accordingly, it is an object of the present invention to provide an in-line roller skate or skate board having a fiber optic lighting assembly which gives safety and aesthetic lighting qualities to the in-line skates or skate board while in use.

Another object of the present invention is to provide in-line skates having fiber optic lighting of high intensity which gives the skater proper and better pathway illumination, brake light illumination and skate illumination for the skater, other skaters, pedestrians, and motorists when in use.

Another object of the present invention is to provide an in-line skate with fiber optic lighting that is durable in use, low in maintenance, and long-lasting for increased lighting and service life of the fiber optic lighting assembly when in use.

A further object of the present invention is to provide an in-line skate that can be mass produced in an automated and economical manner and is readily affordable by the user.

SUMMARY OF THE INVENTION

In accordance with the present invention there is provided an improved in-line roller skate with fiber optic lighting for illuminating a skater's pathway including a boot housing having a plurality of closure means, a top wall, a front wall, a rear wall, side walls and a bottom wall; and a roller wheel assembly connected to the bottom wall of the boot housing including a mounting bracket for supporting a plurality of skate wheels thereon. The in-line roller skate further includes a power source mounted on the boot housing; and a fiber optic lighting assembly for providing light and being connected to the power source and including a light source, a lens and a plurality of fiber optic lines for transmitting light to a plurality of locations on the boot housing and on the mounting bracket.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED AND ALTERNATE EMBODIMENTS OVERVIEW

Figure 1:
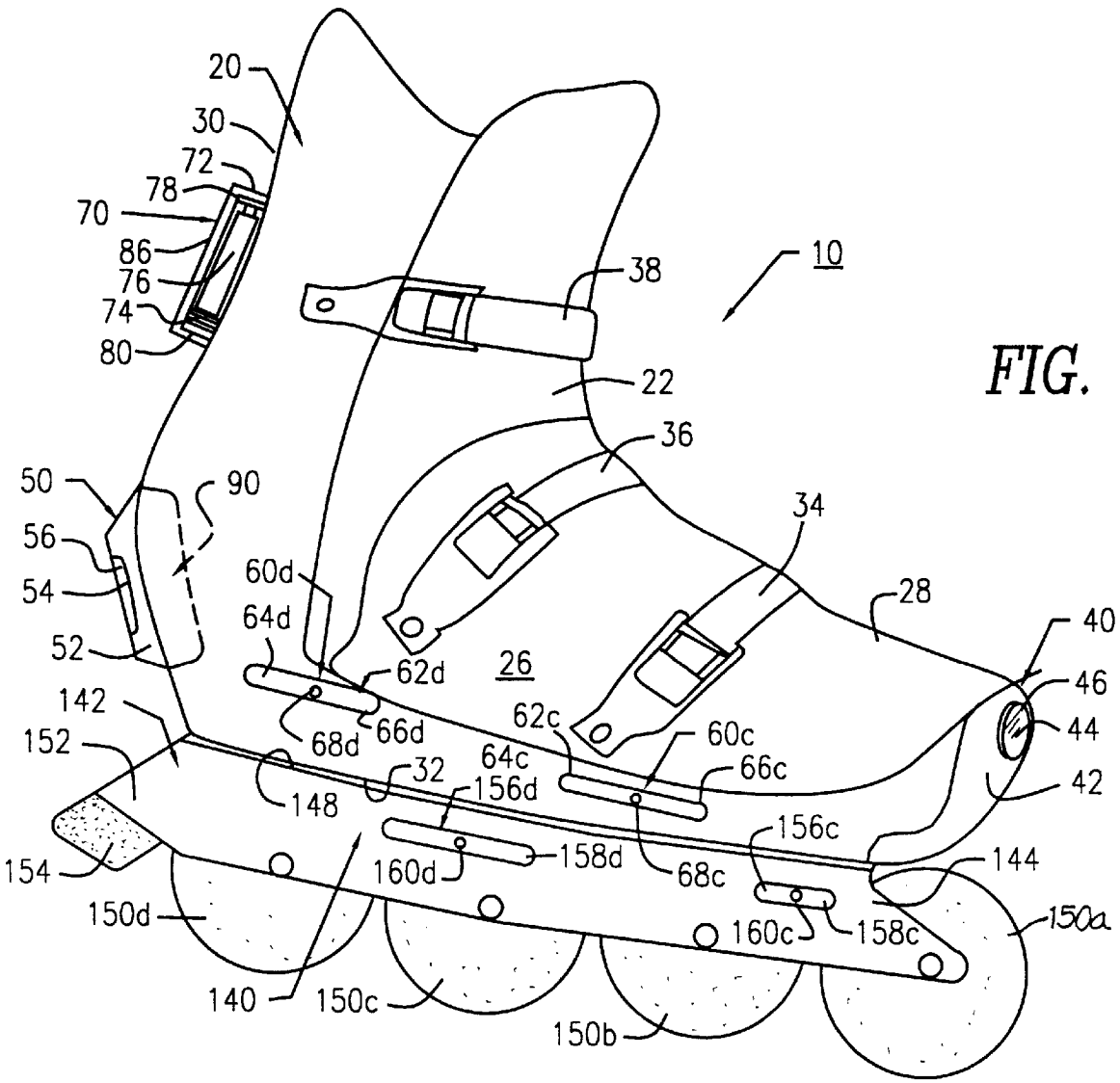
FIG. 1 is a front perspective view of the in-line skate with fiber optic lighting of the preferred embodiment of the present invention showing the major component assemblies contained thereon and in operational use.
Figure 2:
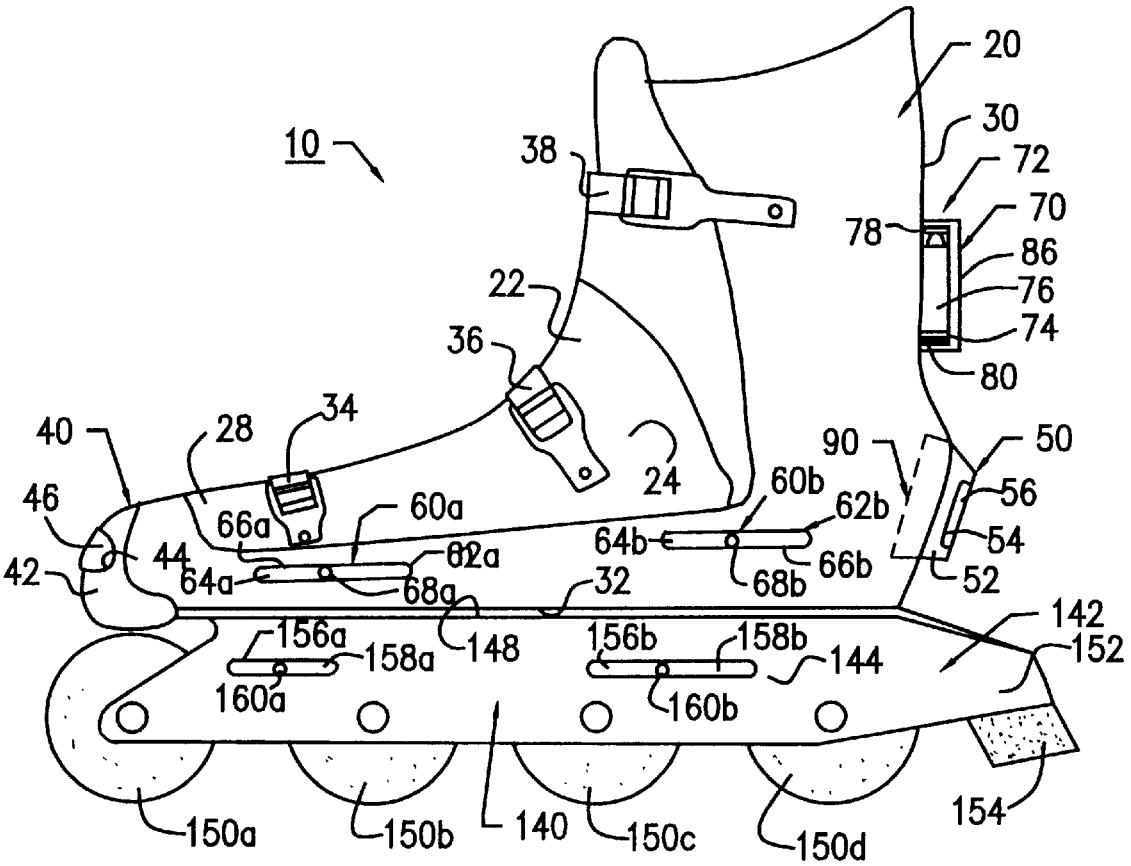
FIG. 2 is a side elevational view of the in-line skate with fiber optic lighting of the present invention showing the boot housing, the front headlight assembly, the sidelight assemblies, the brake light assembly, the power source assembly and the roller wheel assembly.
Figure 3:
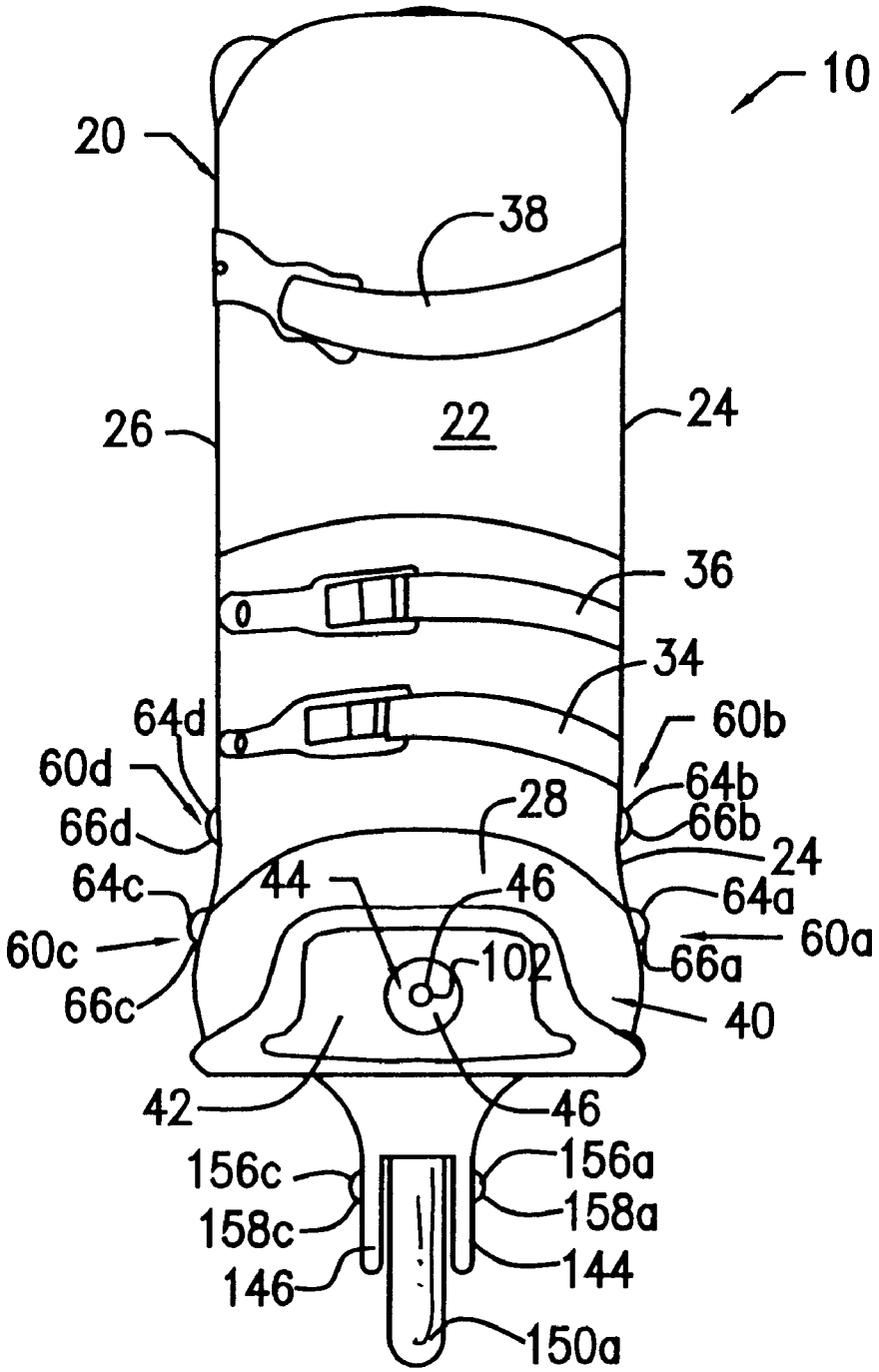
FIG. 3 is a front elevational view of the in-line skate with fiber optic lighting of the present invention showing the boot housing, the front headlight assembly and the roller wheel assembly.

The in-line skate 10 and the skate board 200 having fiber optic lighting 90 and 90' of the preferred and alternate embodiments of the present invention are represented in detail in FIGS. 1 through 8. The in-line skate 10 and the skate board 200 with fiber optic lighting 90 and 90' are sporting gear having lighting for safety and aesthetic values to the wearer. In the preferred embodiment, the in-line skate 10 is shown to incorporate the fiber optic lighting 90 within the boot housing 20 and roller wheel assembly 140; and in the alternate embodiment, the skate board 200 is shown to incorporate the fiber optic lighting 90' within the skate board member 220. In all other respects, the skate board 200 with fiber optic lighting 90' of the alternate embodiment functions and operates in the same manner as the in-line skate 10 with fiber optic lighting 90 of the preferred embodiment.

Preferred Embodiment 10

The in-line skate 10 with fiber optic lighting 90 of the preferred embodiment of the present invention is represented in detail in FIGS. 1 through 6. The in-line skate 10 includes a boot housing 20 having a front headlight assembly 40, a rear brake light assembly 50, sidelight assemblies 60, a power source assembly 70, a optic fiber lighting assembly 90, and a roller wheel assembly 140.

As shown in FIGS. 1 to 5, the boot housing 20 includes a top wall surface 22, inner and outer sidewall surfaces 24 and 26, a front wall surface (toe area) 28, a rear wall surface (heel area) 30, and a bottom wall surface (sole area) 32. Boot housing 20 further includes a plurality of closure straps 34, 36, and 38 for enclosing the user's foot 12 within the boot housing 20.

The front headlight assembly 40 includes a toe plate compartment 42 having a recessed cavity 44 for holding a headlight lens 46 and a circular head-light opening 48 for receiving a plurality of fiber optic strands (bundle) 102 to provide light at this location.

The rear brake light assembly 50 includes a brake light compartment 52 having a recessed cavity 54 for holding a brake light lens 56 and a circular brake light opening 58 for receiving a plurality of fiber optic strands (bundle) 104 to provide light at this location.

The sidelight assemblies 60*a*, 60*b*, 60*c* and 60*d* on boot housing 20 include sidelight compartments 62*a*, 62*b*, 62*c*, and 62*d* having recessed cavities 64*a*, 64*b*, 64*c* and 64*d* in the inner and outer sidewall surfaces 24 and 26 for holding clear or colored sidelight lenses 66*a*, 66*b*, 66*c*, and 66*d*; and circular sidelight hole openings 68*a*, 68*b*, 68*c*, and 68*d* for receiving a plurality of fiber optic strands (bundle) 106, 108, 114 and 116 for providing light at these locations.

As shown in FIGS. 1, 2, 3, and 6, the roller wheel assembly 140 includes a mounting bracket 142 having a plurality of roller wheels 150*a*, 150*b*, 150*c* and 150*d* mounted thereon; and a rear end 152 of mounting bracket 142 having a brake pad 154. The mounting bracket 142 further includes an inner wall surface 144, an outer wall surface 146, and a top wall surface mounting plate 148 for attaching to the bottom wall surface 32 of boot housing 20. The inner and outer wall surfaces 144 and 146 of mounting bracket 142 include recessed cavities 156*a*, 156*b*, 156*c* and 156*d* formed therein for holding clear or colored sidelight lenses 158*a*, 158*b*, 158*c* and 158*d*; and each cavity 156*a* to 156*d* having circular sidelight hole openings 160*a*, 160*b*, 160*c*, and 160*d* for receiving a plurality of fiber optic bundles 110, 112, 118, and 120.

Figure 4:
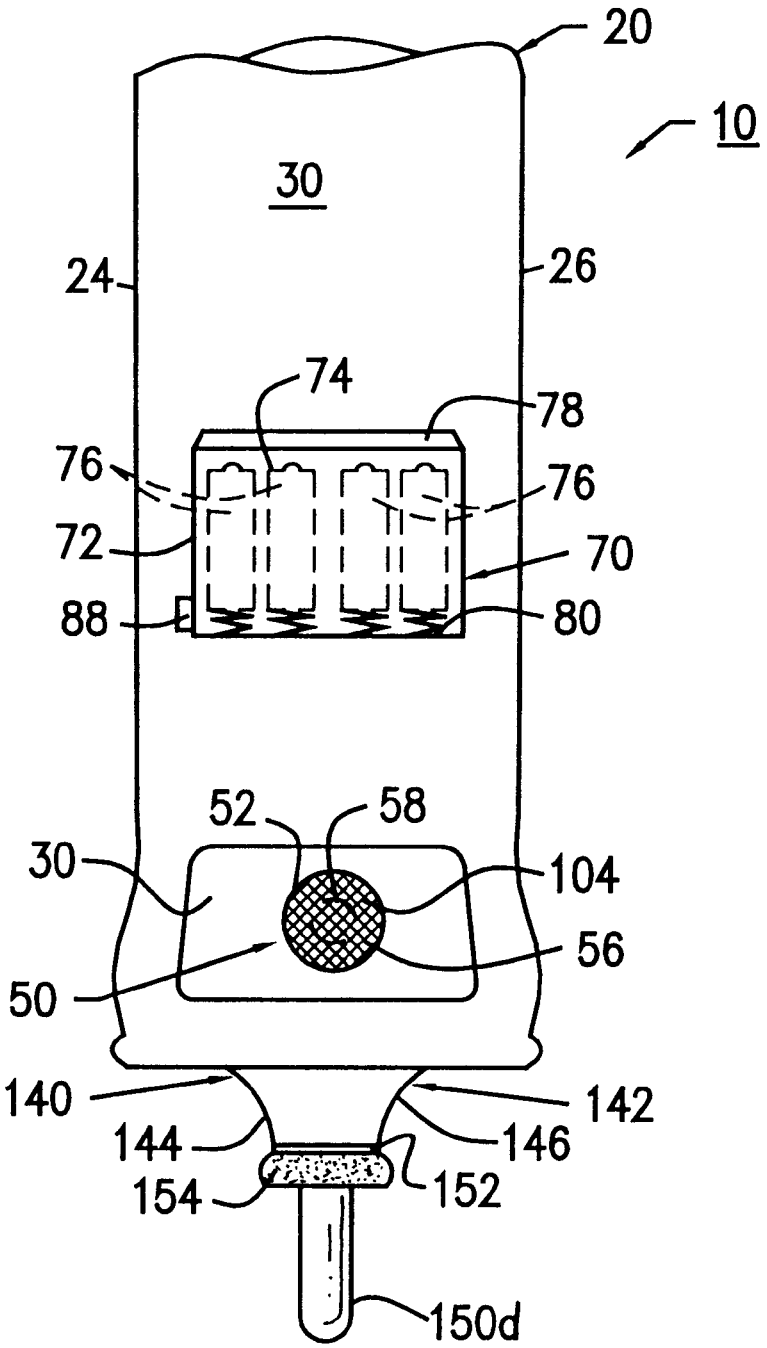
FIG. 4 is a rear elevational view of the in-line skate with fiber optic lighting of the present invention showing the boot housing, the power source assembly, the rear brake light assembly and the roller wheel assembly.
Figure 6:
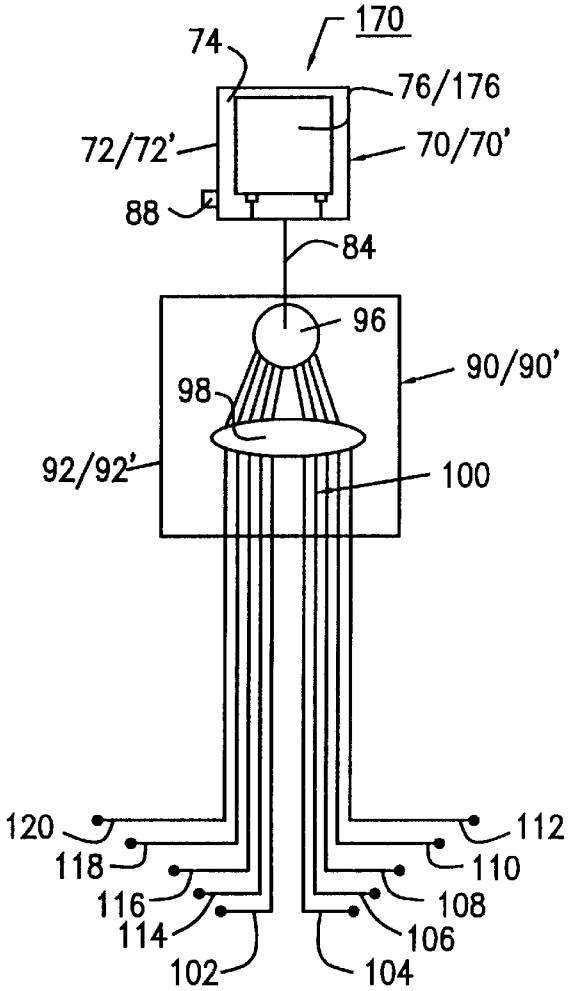
FIG. 6 is a schematic diagram of the in-line skate with fiber optic lighting of the present invention showing the circuitry of the power source assembly and the optic fiber lighting assembly in which to produce a plurality of light beams.
Figure 5:
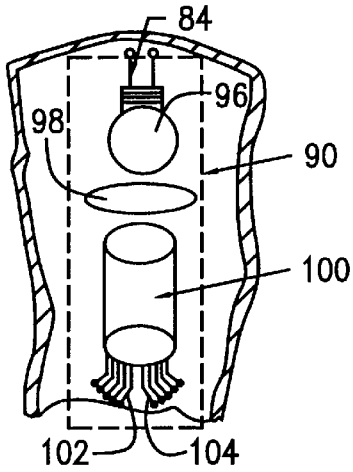
FIG. 5 is an enlarged perspective view of the in-line skate with fiber optic lighting of the present invention showing the optic fiber lighting assembly within the boot housing.
Figure 4A:
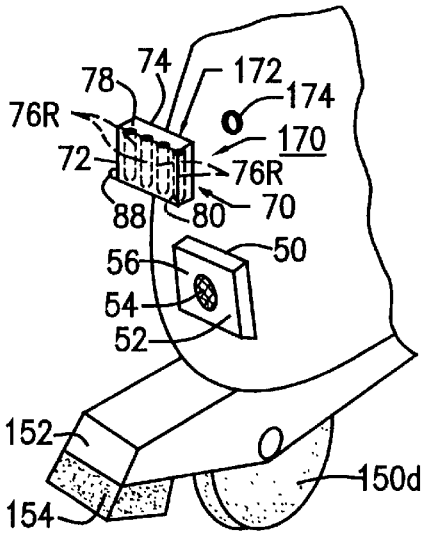
FIG. 4A is a rear perspective view of the in-line skate with fiber optic lighting of the present invention showing an alternate power source assembly having a detachable rechargeable battery.

As shown in FIG. 4, the power source assembly 70 includes a battery pack housing 72 having an internal compartment 74 for holding a plurality of releasable batteries 76. The internal compartment 74 includes a positive (+) plate member 78, and a negative (−) plate member 80 for transferring electrical current 84, a snap-on cover 86 and an ON/OFF switch 88. The power source assembly 70 is located on the rear wall surface 30 of boot housing 20. Alternate power source assemblies are available, being a rechargeable battery 76R or a power source assembly 170 that includes a detachable housing 172 having a rechargeable power battery unit 176 with a snap-on electrical current connection 174 which connects to the optic fiber lighting assembly 90; and an ON/OFF switch 88.

As shown in FIGS. 1 to 4 and 6, the fiber optic lighting assembly 90 includes an optic fiber lighting housing 92 having a bulb socket 94, a bulb 96, a lens 98 and a plurality fiber optic bundles (strands) forming an array 100 for lighting the various light components contained therein. The fiber optic bundle array 100 includes a headlight bundle 102, a brake light bundle 104, and right and left sidelight bundles 106, 108, 110, 112, 114, 116, 118, and 120 for the boot housing 20 and mounting bracket 142.

In operation, the skater turns on switch 88 which activates bulb 96 which in turn provides light to the fiber optic bundles 102, 104, 106, 108, 114, 116, 110, 112, 118, and 120. In this manner, the boot 20 and roller wheel assembly 140 provide both safety light and aesthetic light.

Alternate Embodiment 200

Figure 7:
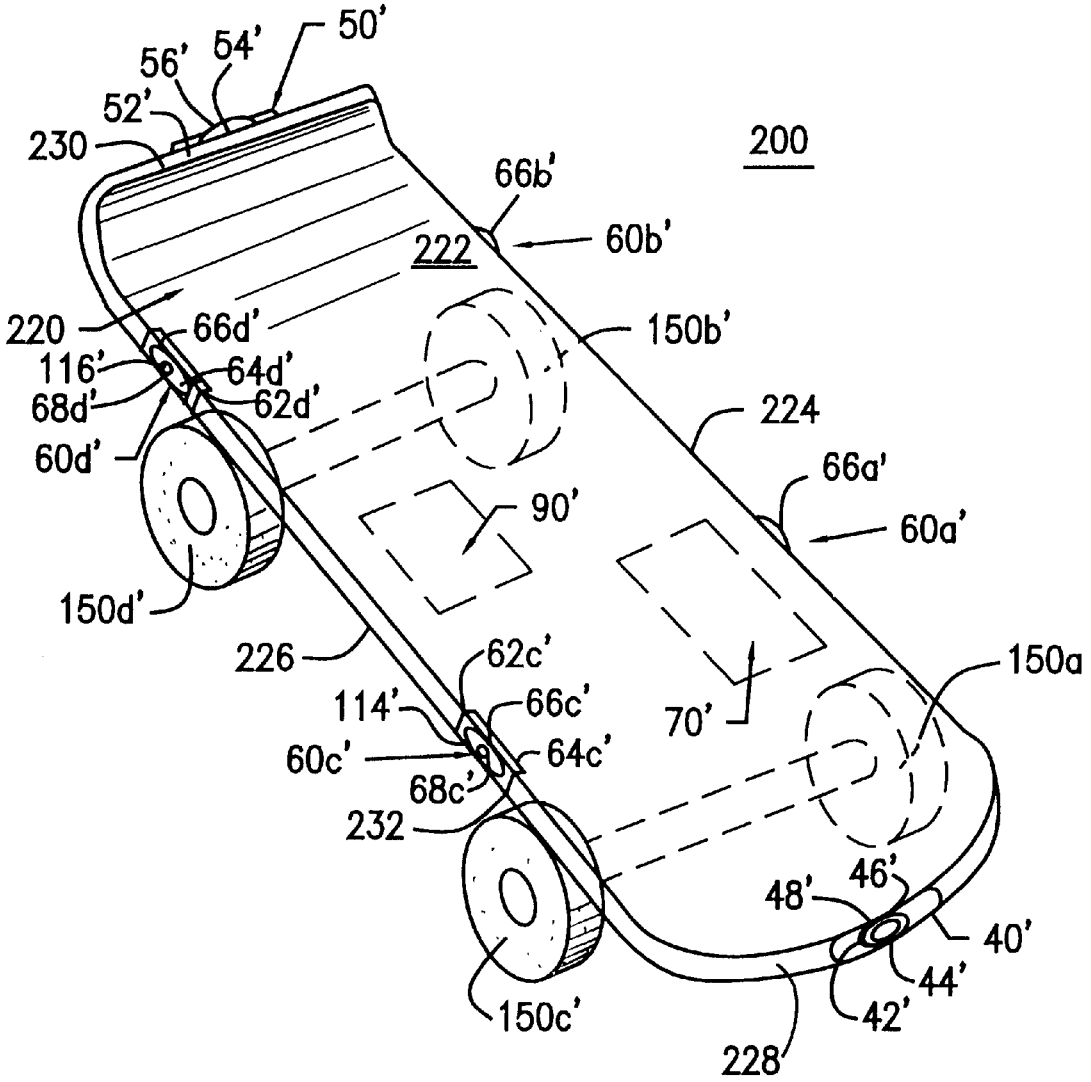
FIG. 7 is a front perspective view of the skate board with fiber optic lighting of the alternate embodiment of the present invention showing the major component assemblies contained thereon and in operational use.
Figure 8:
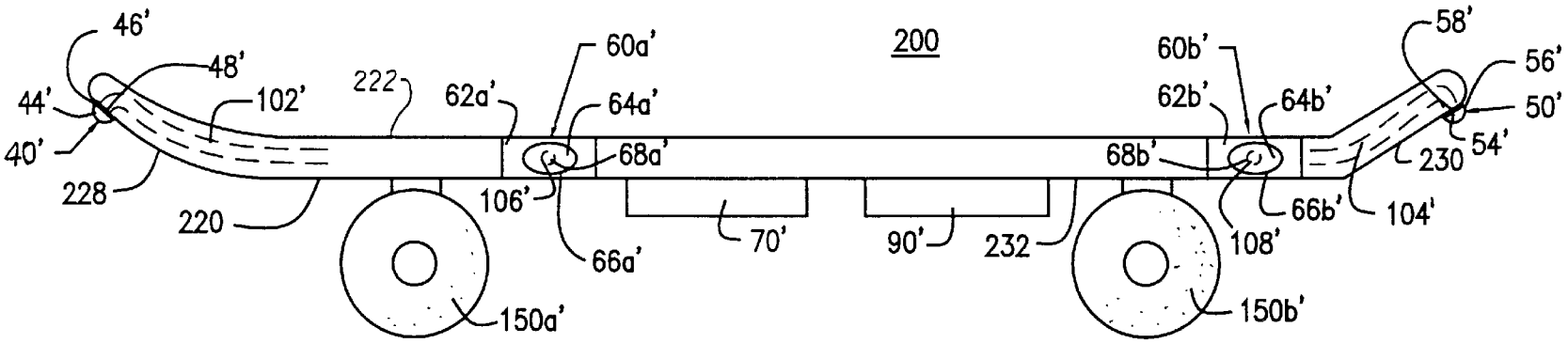
FIG. 8 is a side elevational view of the skate board with fiber optic lighting of the present invention showing the skate board member, the front headlight assembly, the sidelight assemblies, the brake light assembly, the power source assembly, the optic fiber lighting assembly and the skate wheel assembly.

As shown in FIGS. 7 and 8, the skate board 200 with fiber optic lighting 90' of the alternate embodiment of the present invention includes a skate board member 220, a headlight assembly 40', a brake like assembly 50', sidelight assemblies 60', a power source assembly 70', an optic fiber lighting assembly 90', and a skate wheel assembly 150'. Skate board member 220 includes a top wall surface 222, a left side wall surface 224, a right side wall surface 226, a front wall surface 228, a rear wall surface 230, and a bottom wall surface 232. All other functional and operational aspects of the alternate embodiment 200 remain the same as the preferred embodiment 10 of the present invention.

As shown in FIGS. 7 and 8, the front headlight assembly 40' includes a front plate compartment 42' having a recessed cavity 44' for holding a headlight lens 46' and a circular headlight opening 48' for receiving a plurality of fiber optic strands (bundle) 102' to provide light at this location. Front headlight assembly 40' is located on the front wall surface 228 of skate board member 220.

The rear brake light assembly 50' includes a brake light compartment 52' having a recessed cavity 54' for holding a brake light lens 56' and a circular brake light opening 58' for receiving a plurality of fiber optic strands (bundle) 104' to provide light at this location. Brake light assembly 50' is located on the rear wall surface 230 of skate board member 220.

The sidelight assemblies 60*a*', 60*b*', 60*c*' and 60*d*' on skate board member 220 include sidelight compartments 62*a*', 62*b*', 62*c*', and 62*d*' having recessed cavities 64*a*', 64*b*', 64*c*' and 64*d*' in the outer sidewall surfaces 224 and 226 respectively, for holding clear or colored sidelight lenses 66*a*', 66*b*', 66*c*', and 66*d*'; and circular sidelight hole openings 68*a*', 68*b*', 68*c*', and 68*d*' for receiving a plurality of fiber optic strands (bundle) 106', 108', 114' and 116' for providing light at these locations.

The power source assembly '70 having a battery pack housing '72 and the fiber optic lighting assembly '90 having a housing '92 are both mounted and located on the bottom wall surface 232 of skate board member 220, as shown in FIG. 8 of the drawings.

Advantages of the Present Invention

Accordingly, an advantage of the present invention is that it provides an in-line roller skate (blades) having a fiber optic lighting assembly which gives safety and aesthetic lighting qualities to the in-line skates while in use.

Another advantage of the present invention is that it provides for an in-line skate having fiber optic lighting of high intensity which gives the skater proper and better pathway illumination, brake light illumination and skate illumination for the skater, other skaters, pedestrians, and motorists when in use.

Another advantage of the present invention is that it provides for an in-line skate with fiber optic lighting that is durable in use, low in maintenance, and long-lasting for increased lighting and service life of the fiber optic lighting assembly when in use.

A further advantage of the present invention is that it provides for an in-line skate that can be mass produced in an automated and economical manner and is readily affordable by the user.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An in-line roller skate with a fiber optic lighting assembly for illuminating a skater's pathway, comprising:

a) a boot housing having a plurality of closure means, a top wall, a front wall, a rear wall, side walls and a bottom wall;

b) a roller wheel assembly connected to said bottom wall of the boot housing including a mounting bracket for supporting a plurality of roller skate wheels thereon;

c) power source means mounted on said boot housing, said power source means being located on the exterior of said rear wall of said boot housing, and said power source means including batteries;

d) a fiber optic lighting assembly for providing light and being connected to said power source means, including a light source, a lens and a plurality of fiber optic lines for transmitting light to a plurality of locations on said boot housing and on said mounting bracket, and said light source of said fiber optic lighting assembly being located on the interior area of said rear wall of said boot housing and adjacent to said power source means;

e) one of said plurality of fiber optic lines for transmitting light being connected to a headlight assembly, said head light assembly being located on said front wall of said boot housing; and f) another one of said plurality of fiber optic lines for transmitting light being connected to a brake light assembly, said brake light assembly being located on said rear wall of said boot housing.

2. An in-line roller skate with fiber optic lighting in accordance with claim 1, further including four side light assemblies mounted on both sidewalls of said boot housing, and wherein four of said plurality of fiber optic lines for transmitting light are connected to said four side light assemblies, respectively.

3. An in-line roller skate with fiber optic lighting in accordance with claim 1, further including four lower side light assemblies mounted on both sides of said mounting bracket, and wherein four of said plurality of fiber optic lines for transmitting light are connected to said four lower side light assemblies, respectively.

* * * * *